US008388180B2

(12) United States Patent
Chang et al.

(10) Patent No.: US 8,388,180 B2
(45) Date of Patent: Mar. 5, 2013

(54) VARIABLE SHAPED LAMP SHADE OF LED LAMP

(76) Inventors: Chih-Yang Chang, Taoyuan County (TW); Hsing-Kuei Liu, Hsinchu County (TW)

( * ) Notice: Subject to any disclaimer, the term of this patent is extended or adjusted under 35 U.S.C. 154(b) by 153 days.

(21) Appl. No.: 12/941,934

(22) Filed: Nov. 8, 2010

(65) Prior Publication Data

US 2012/0092876 A1 Apr. 19, 2012

(30) Foreign Application Priority Data

Oct. 19, 2010 (TW) ..... 99220155 U

(51) Int. Cl.
*F21V 5/00* (2006.01)

(52) U.S. Cl. ..... 362/244; 362/217.04; 362/224; 362/249.02; 362/291; 362/311.02

(58) Field of Classification Search ..... 362/217.02–217.04, 224, 244, 362/246, 249.02, 290–291, 311.02, 311.06–311.1, 362/332–340, 800
See application file for complete search history.

(56) References Cited

U.S. PATENT DOCUMENTS 7,159,997 B2 * 1/2007 Reo et al. ..... 362/240

* cited by examiner

*Primary Examiner* — Jason Moon Han
(74) *Attorney, Agent, or Firm* — Tracy M. Heims; Apex Juris, pllc

(57) ABSTRACT

In a variable shaped lamp shade of an LED lamp, the lamp shade is made of a translucent material matched with an LED lamp strip and a lamp holder and includes at least one strip-shaped optical refraction unit having an external refractive surface, an internal refractive surface corresponding to the external refractive surface, and an assembling structure for matching the lamp holder. The external refractive surface or internal refractive surface is a curved surface without an inflection point and the curved surface has a constant or gradually changing curvature; and a non-curved surface is formed on the other side. The variable shaped lamp overcomes the problems of conventional LED lamp strips having a low illumination and a non-uniform illumination caused by a direct projection or an installation of a conventional lamp shade, and a low light utility caused by a too-large illumination range.

8 Claims, 10 Drawing Sheets

VARIABLE SHAPED LAMP SHADE OF LED LAMP

CROSS-REFERENCE TO RELATED APPLICATION

This non-provisional application claims priority under 35 U.S.C. §119(a) on Patent Application No(s).099220155 filed in Taiwan, R.O.C. on Oct. 19, 2010, the entire contents of which are hereby incorporated by reference.

FIELD OF THE INVENTION

The present invention relates to a lamp shade of an illumination lamp, in particular to a variable shaped lamp shade of a light emitting diode (LED) lamp.

BACKGROUND OF THE INVENTION

Light emitting diode (LED) has become a new-generation light source for illumination due to its advantages such as power saving and long lifespan, and the LED is used extensively as a light source in many different fields and it gradually replaces traditional incandescent lamps and fluorescent tubes. For example, a long striped substrate including a plurality of high-brightness light-emitting diodes (HB-LED) arranged in a row is used to replace the fluorescent tube. However, the intensity of the illumination of the LED is relatively low and the illumination is not uniform enough, such that its application as a lamp still requires a lamp shade to perform a secondary light distribution. However, most LED lamp shades available in the market and used for the secondary light distribution emphasize on the protection of the light source only, but such conventional LED lamp shades usually provide no design for a more efficient light distribution of the LED light source. Even though some LED lamp shades may come with an anti-glare design or a simple secondary light distribution design, a common design with a spherical surface generally results in a less efficient light distribution effect.

In addition, the lamp shade used for the traditional light source (incandescent lamp or fluorescent tube) emphasizes on the protection and decoration of the lamp only, but seldom provides a functional effect or improves the light distribution of the light source. The design of some lamp shades may take the light distribution of the lamp shade into consideration, but the conventional lamp shade only comes with a simple light distribution design, such as using a cylindrical surface as the curved surface of the lamp shade, and such cylindrical surface has no or little change of curvature that can just proportionally narrow the light emitted from the traditional light source, but such lamp shade cannot be applied to the lamp of the LED light source at all. More specifically, the LED light source is close to a point light source whose emitting light has the greatest brightness at the middle and a decremented brightness towards the periphery, so that when the lamp shade for the traditional light source is applied to a lamp of the LED light source, the LED light source will be further narrowed proportionally, and thus resulting in a phenomenon of a too-bright middle (or a non-uniform light illumination). Particularly in most of the present existing lamps applied for the planar illumination, the too-bright middle phenomenon will be more significant. To improve this problem, related designers and manufacturers adopt a solution of installing more LEDs, but such design of installing more LEDs further introduces the drawbacks of high power consumption and incompliance with the cost-effectiveness and the power saving effect of the LED lamps.

Therefore, it is a main subject of the present invention to disclose a lamp shade of an LED light source that provides a functional effect or improves the light distribution of the light source to overcome the aforementioned problems of the conventional lamp shade having a poor light distribution.

SUMMARY OF THE INVENTION

In view of the shortcomings of the conventional LED lamp shade and its application in LED lamps, the inventor of the present invention based on years of experience in the related industry to conduct extensive researches and experiments, and finally developed a variable shaped lamp shade of an LED lamp in accordance with the present invention, in hope of achieving the effects of enhancing the intensity of illumination, providing a uniform illumination, and saving electric power.

It is a primary objective of the present invention to provide a variable shaped lamp shade of an LED lamp and use a special optical structural design of the lamp shade to control the light passing through the lamp shade, and diffuse the light uniformly within a specific range of angles in order to achieve the effects of enhancing the intensity of illumination, providing a uniform illumination, and saving electric power.

To achieve the foregoing and other objectives, the present invention discloses a variable shaped lamp shade of an LED lamp, and the lamp shade is made of a translucent material matched with an LED lamp strip and a lamp holder, and the lamp shade comprises: at least one strip-shaped optical refraction unit, having an external refractive surface, an internal refractive surface corresponding to the external refractive surface and an assembling structure matched with the lamp holder, wherein the external refractive surface or the internal refractive surface is formed on a curved surface without an inflection point, and the curved surface has a constant curvature or a gradually changing curvature.

In a preferred embodiment of the present invention, the external refractive surface of the optical refraction unit is a curved surface without an inflection point, and the curved surface has a constant or gradually changing curvature; the internal refractive surface of the optical refraction unit is a non-spherical surface, and the external refractive surface of the optical refraction unit can also be a non-spherical surface; and the internal refractive surface of the optical refraction unit is a curved surface without an inflection point, and the curved surface has a constant or gradually changing curvature; and two reflective surfaces can be formed and coupled to both lateral sides of the external refractive surface and the internal refractive surface respectively, and the reflective surfaces are outwardly convex curved surface.

To overcome the glare problem, the present invention further comprises a small curved surface formed on the external refractive surface and along the profile of the curved surface or the profile of the non-spherical surface for preventing glares.

To cope with the characteristics of the LED light source, the present invention further provides a lamp shade made of a fire-resisting and durable material such as polycarbonate (PC).

To fit different shapes of LED lamps, the present invention further provides a strip-shaped lamp shade, a fan-shaped lamp shade or a ring-shaped lamp shade. The strip-shaped lamp shade includes two or more rectangular optical refraction units arranged in parallel to each other; the fan-shaped lamp shade includes two or more radial or concentric optical refraction units; and the ring-shaped lamp shade includes two or more radial or concentric optical refraction units, such that each optical refraction unit with the aforementioned characteristics is arranged corresponding to each row of LEDs of the LED lamp to perform the light distribution for each row of LEDs.

In the variable shaped lamp shade of an LED lamp in accordance with the present invention, the aforementioned special optical structural design of the lamp shade controls the light passing through the lamp shade and diffuses the light uniformly within a specific range of angles to achieve the effects of enhancing the intensity of illumination, providing a uniform illumination, and saving electric power.

DETAILED DESCRIPTION OF THE PREFERRED EMBODIMENTS

The objects, characteristics and effects of the present invention will become apparent with the detailed description of the preferred embodiments and the illustration of related drawings as follows.

Figure 1:
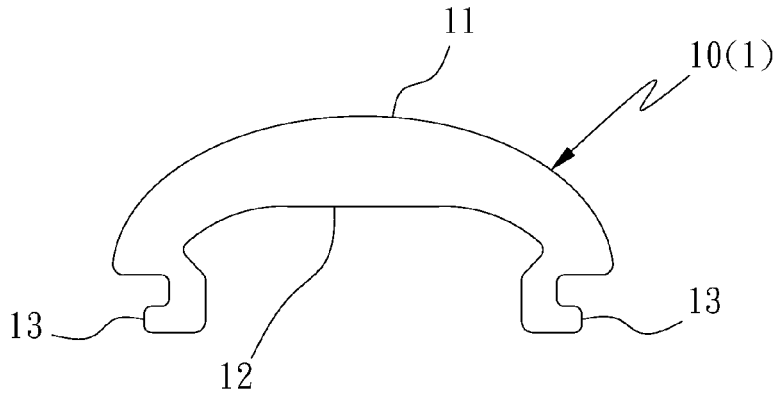
FIG. 1 is a cross-sectional view of a first preferred embodiment of the present invention.
Figure 2:
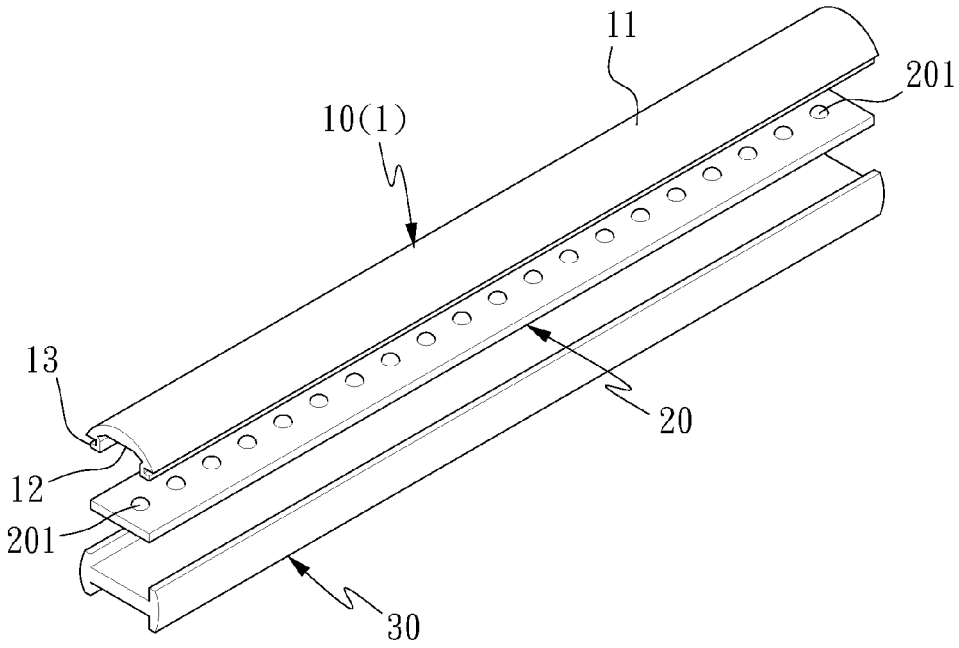
FIG. 2 is a schematic view showing an application of a first preferred embodiment of the present invention.

With reference to FIGS. 1 and 2 for a variable shaped lamp shade of an LED lamp in accordance with a first preferred embodiment of the present invention, the lamp shade 10 is made of a translucent material matched with an LED lamp strip 20 and a lamp holder 30, and the lamp shade 10 comprises at least one strip-shaped optical refraction unit 1, and each optical refraction unit 1 has an external refractive surface 11, an internal refractive surface 12 corresponding to the external refractive surface 11, and an assembling structure 13 for matching the lamp holder 30, and the optical refraction unit 1 has a cross-sectional structure substantially in an Ω shape, wherein the external refractive surface 11 of the optical refraction unit 1 is a curved surface without an inflection point, and the curved surface has a constant or gradually changing curvature; and the internal refractive surface 12 of the optical refraction unit 1 is a non-spherical surface such as a plane, and the internal refractive surface 12 also can be a curved surface with one or more inflection points, and the curved surface has a gradually changing curvature.

Figure 3:
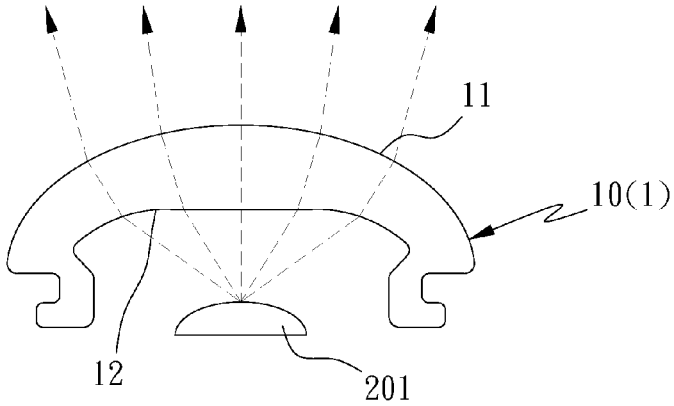
FIG. 3 is a schematic view showing a refraction effect of a first preferred embodiment of the present invention.
Figure 4:
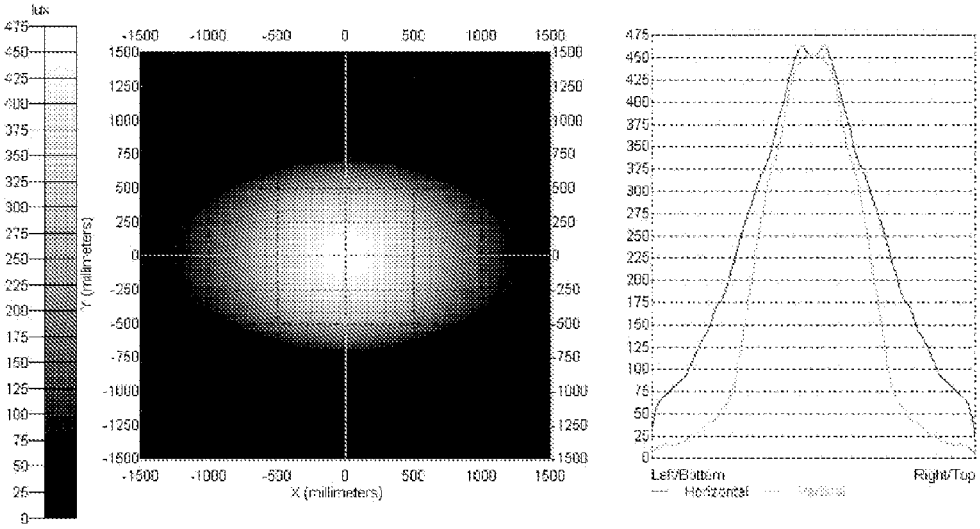
FIG. 4 is a schematic view showing an illumination experiment result of a first preferred embodiment of the present invention.

With reference to FIGS. 2 and 3 for the structural design of the optical refraction unit 1, the LED lamp strip 20 includes an LED 201 installed thereon and provided for emitting light to a position corresponding to the internal refractive surface 12, and the diffused light is passed through the internal refractive surface 12 for a first-time refraction, and when the light is passed through the external refractive surface 11, a second-time refraction will occur, such that the light of the LED 201 will be distributed once again, and the angle of distributed light at edges is controlled within a range of 30 degrees to 100 degrees as shown in FIG. 4, and light spots projected onto the plane are in an elliptical shape with an aspect ratio. The projection on the plane is taken into consideration for the structural design of the optical refraction unit 1 of the present invention, and the aforementioned structural design distributes the light of the LED 201 into a specific range of angles, so that the uniformity of the illumination projected onto a plane is improved significantly, and the brightness of the illumination at the projected area is enhanced greatly. Under the same illumination requirements, the number of the LEDs 201 installed to the LED lamp strip 20 can be reduced, so that the effects of improving the illumination, enhancing the uniformity of the illumination, and saving power can be achieved.

Figure 5:
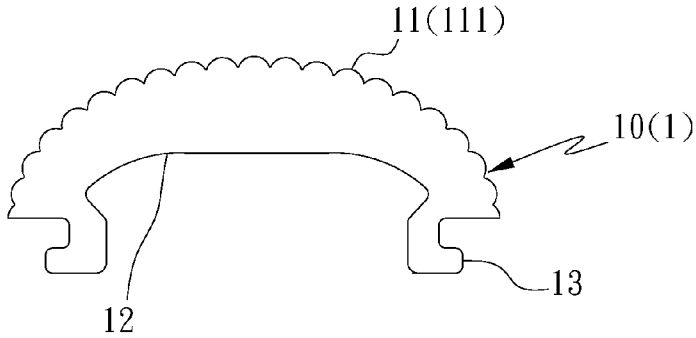
FIG. 5 is a schematic view showing a small curve surface of a first preferred embodiment of the present invention.
Figure 6:
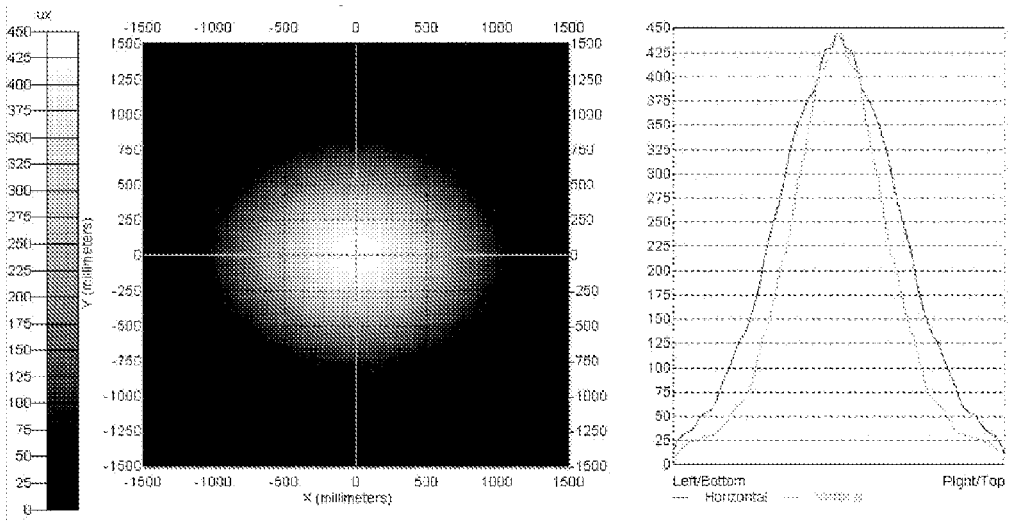
FIG. 6 is a schematic view showing an experiment result of illumination at a small curve surface of a first preferred embodiment of the present invention.

With reference to FIGS. 5 and 6, the present invention further improves the aforementioned structural design of the optical refraction unit 1 to overcome the glare problem by adding a small curve 111 on the external refractive surface 11 of the optical refraction unit 1 protruded continuously along the curved surface.

Figure 7:
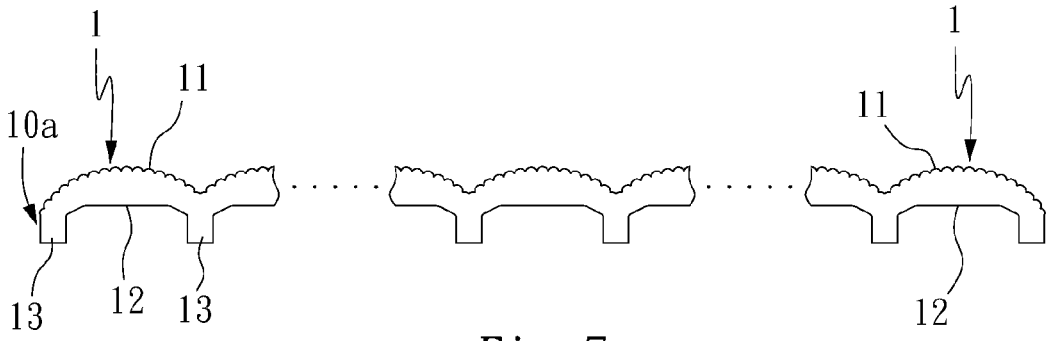
FIG. 7 is a cross-sectional view showing an application as a strip-shaped lamp shade in accordance with a first preferred embodiment of the present invention.
Figure 8:
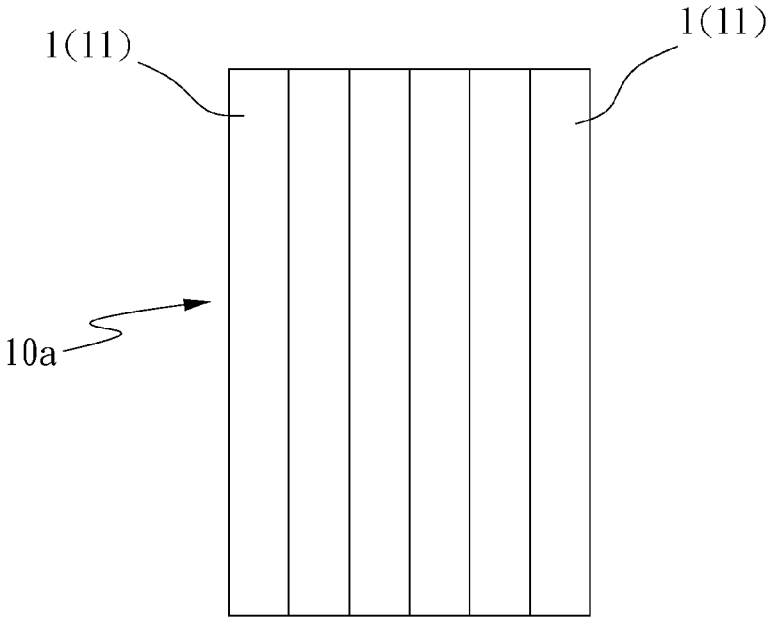
FIG. 8 is a front view showing an application as a strip-shaped lamp shade in accordance with a first preferred embodiment of the present invention.
Figure 9:
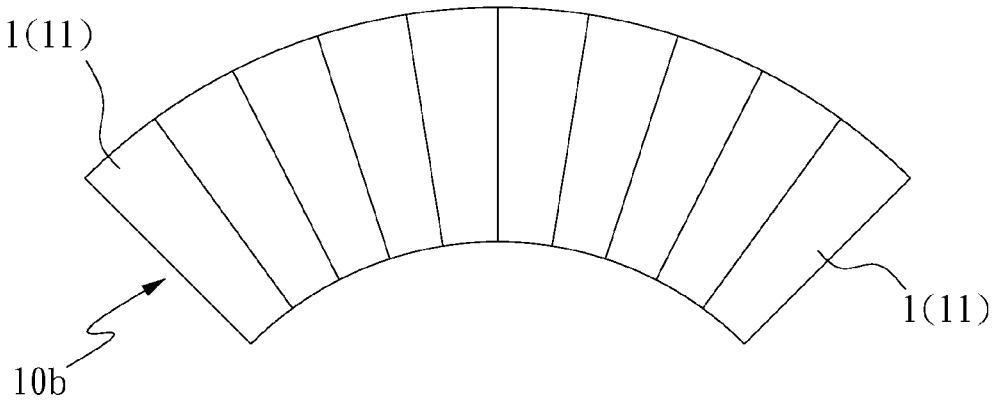
FIG. 9 is a front view showing an application as a fan-shaped lamp shade in accordance with a first preferred embodiment of the present invention.
Figure 10:
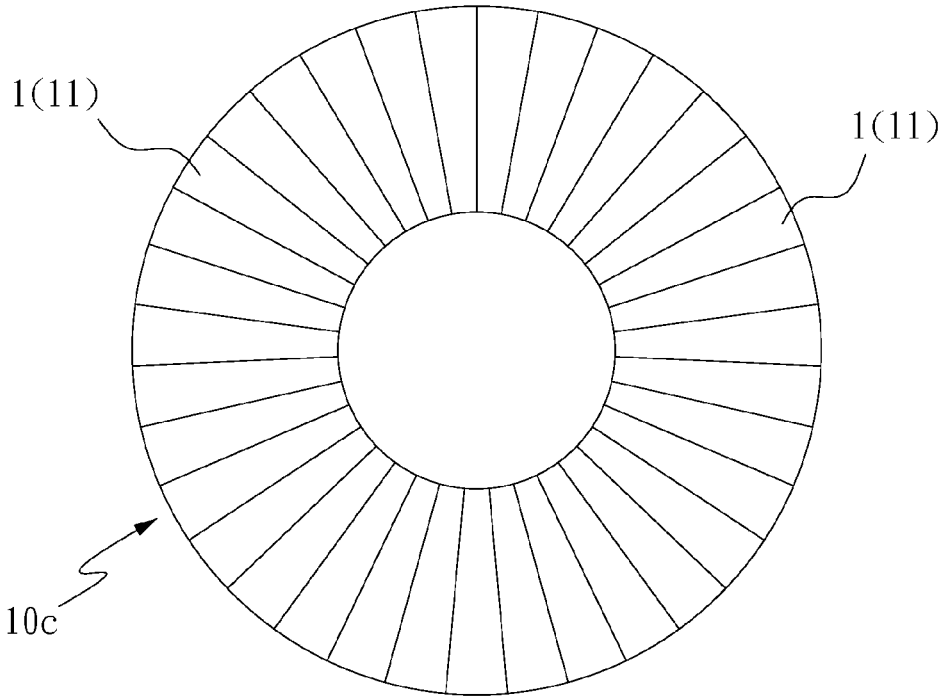
FIG. 10 is a front view showing an application as a ring-shaped lamp shade and its radial arrangement in accordance with a first preferred embodiment of the present invention.
Figure 11:
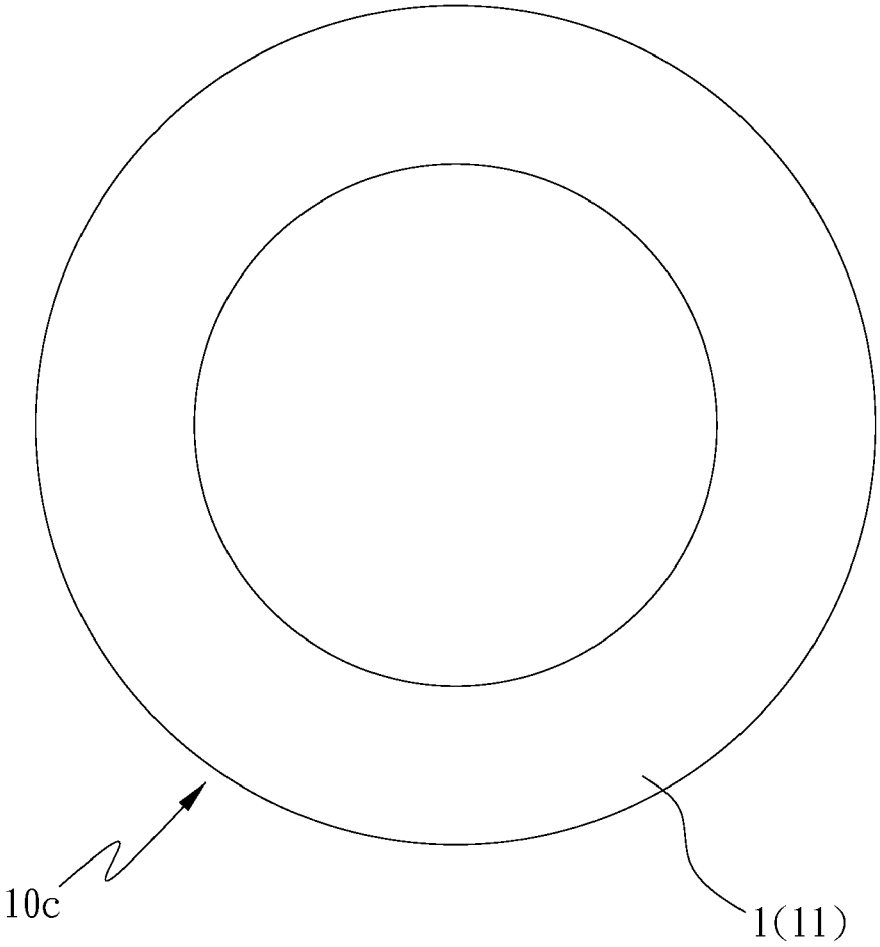
FIG. 11 is a front view showing an application as a ring-shaped lamp shade in accordance with a first preferred embodiment of the present invention.
Figure 12:
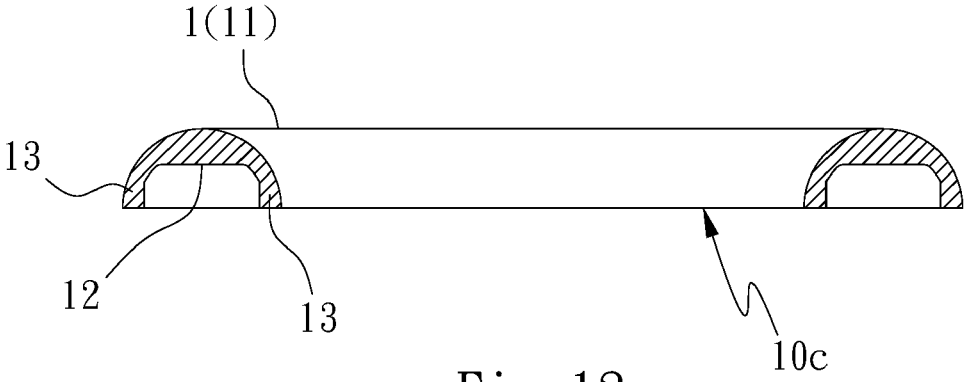
FIG. 12 is a cross-sectional view showing an application as a ring-shaped lamp shade in accordance with a first preferred embodiment of the present invention.
Figure 13:
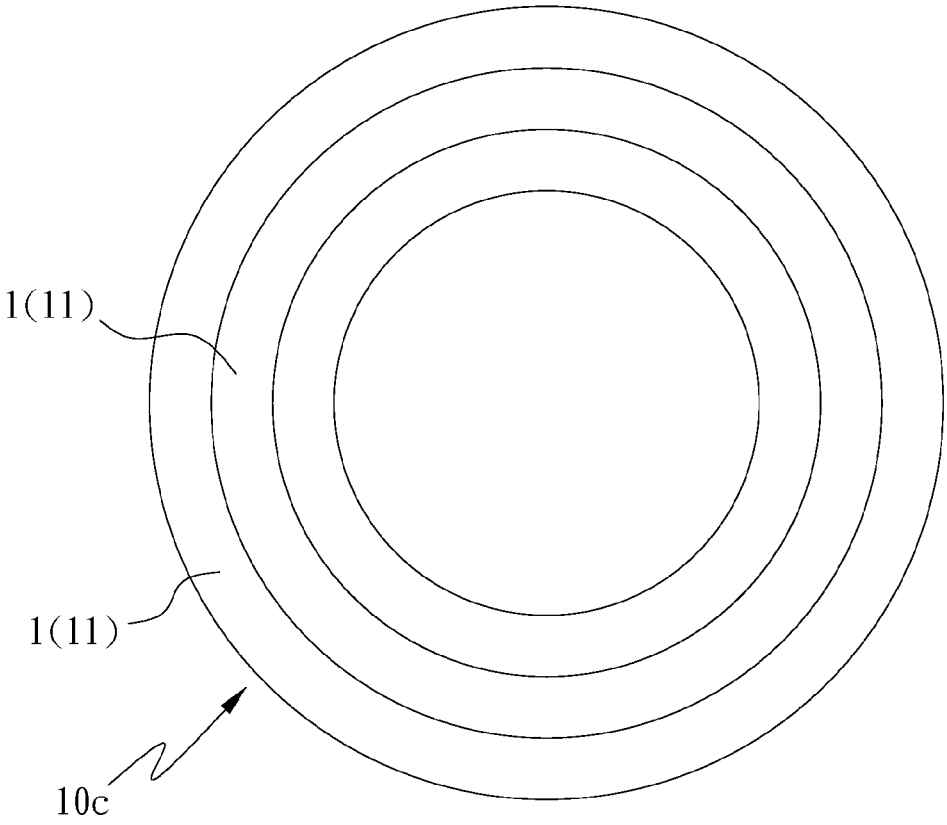
FIG. 13 is a front view showing an application as a ring-shaped lamp shade and its concentric arrangement in accordance with a first preferred embodiment of the present invention.
Figure 14:
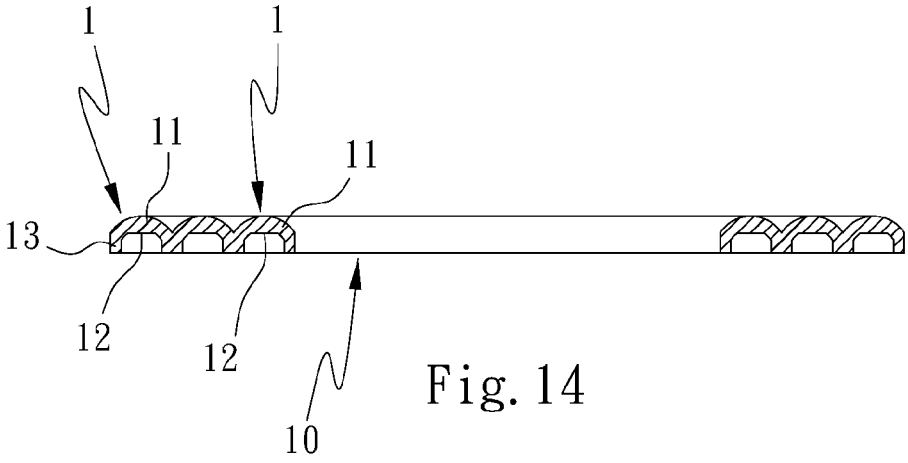
FIG. 14 is a cross-sectional view showing an application as a ring-shaped lamp shade and its concentric arrangement in accordance with a first preferred embodiment of the present invention.

In order to apply the lamp shade to the lamps of various different shapes, the present invention further improves the structure of the aforementioned optical refraction unit 1 by making the lamp shade 10 into a strip-shaped lamp shade, a fan-shaped lamp shade or a ring-shaped lamp shade. In FIGS. 7 and 8, the strip-shaped lamp shade 10*a* includes two or more rectangular optical refraction units 1 arranged parallelly adjacent to each other, and each optical refraction unit 1 has the aforementioned external refractive surface 11, internal refractive surface 12 and assembling structure 13 and the optical refraction units 1 are arranged in rows and disposed corresponding to the LED lamp strip. In FIG. 9, the fan-shaped lamp shade 10*b* similarly includes two or more optical refraction units 1. The optical refraction units 1 are radially arranged to form the fan-shaped lamp shade 10*b*. In FIGS. 10 to 14, the lamp shade of the present invention can also be a ring-shaped lamp shade 10*c* having one or two or more radial or concentric optical refraction units 1. Each optical refraction unit 1 corresponds to each row of LEDs of the LED lamp for performing a light distribution for each row of LEDs to achieve the effects of improving the illumination, enhancing the uniformity of the illumination, and saving power.

Figure 15:
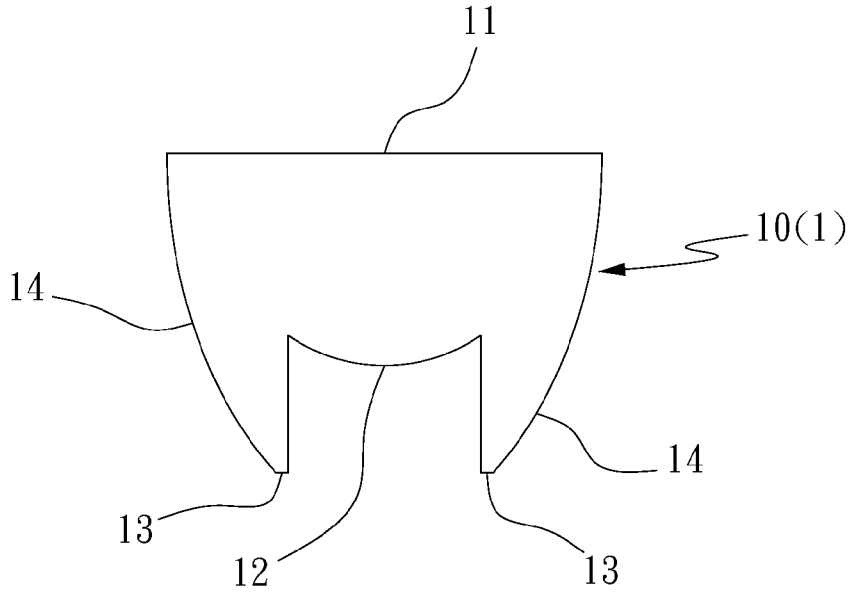
FIG. 15 is a cross-sectional view of a second preferred embodiment of the present invention.
Figure 16:
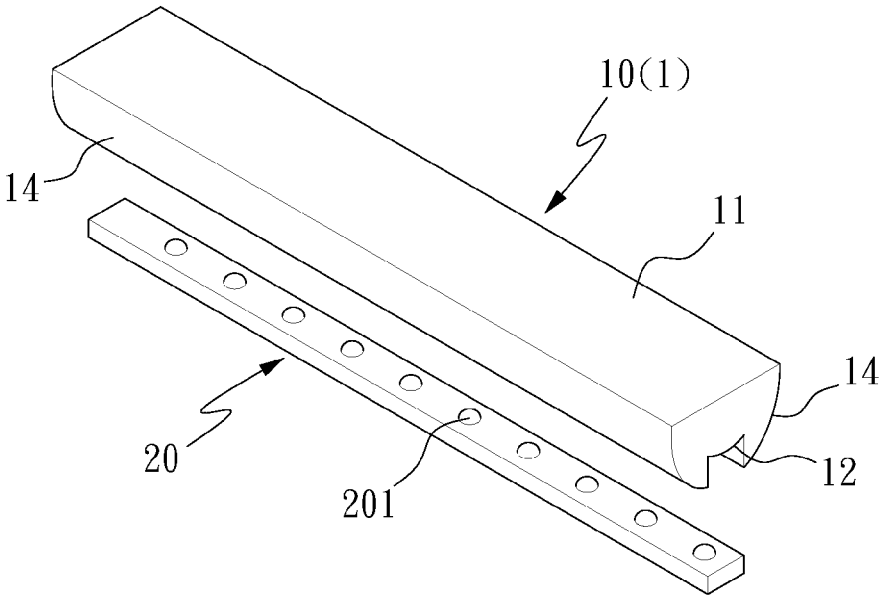
FIG. 16 is a schematic view showing an application of a second preferred embodiment of the present invention.

With reference to FIGS. 15 and 16 for a variable shaped lamp shade of an LED lamp in accordance with a second preferred embodiment of the present invention, the lamp shade 10 comprises at least one strip-shaped optical refraction unit 1, and the optical refraction unit 1 also includes an external refractive surface 11, an internal refractive surface 12 corresponding to the external refractive surface 11, and an assembling structure 13 matched with a lamp holder 30, wherein the external refractive surface 11 of the optical refraction unit 1 is a non-spherical surface such as a plane, and the internal refractive surface 12 is a curved surface without an inflection point, and the internal refractive surface 12 of the curved surface has a constant or gradually changing curvature. In addition, two reflective surfaces 14 can be protruded from both lateral sides of the external refractive surface 11 and the internal refractive surface 12 respectively, and the reflective surfaces 14 are outwardly convex curved surface. The external refractive surface 11 is a non-curved surface or a curved surface with one or more inflection points, and the curved surface has a gradually changing curvature.

Figure 17:
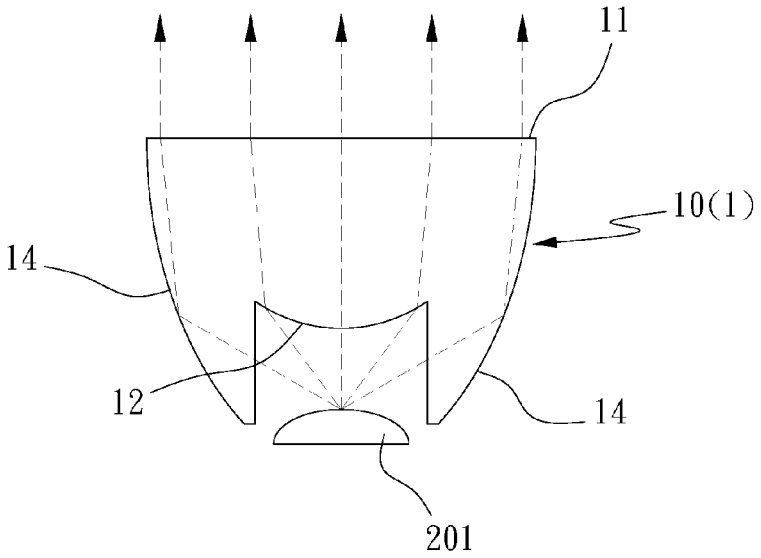
FIG. 17 is a schematic view of a refraction effect of a second preferred embodiment of the present invention.
Figure 18:
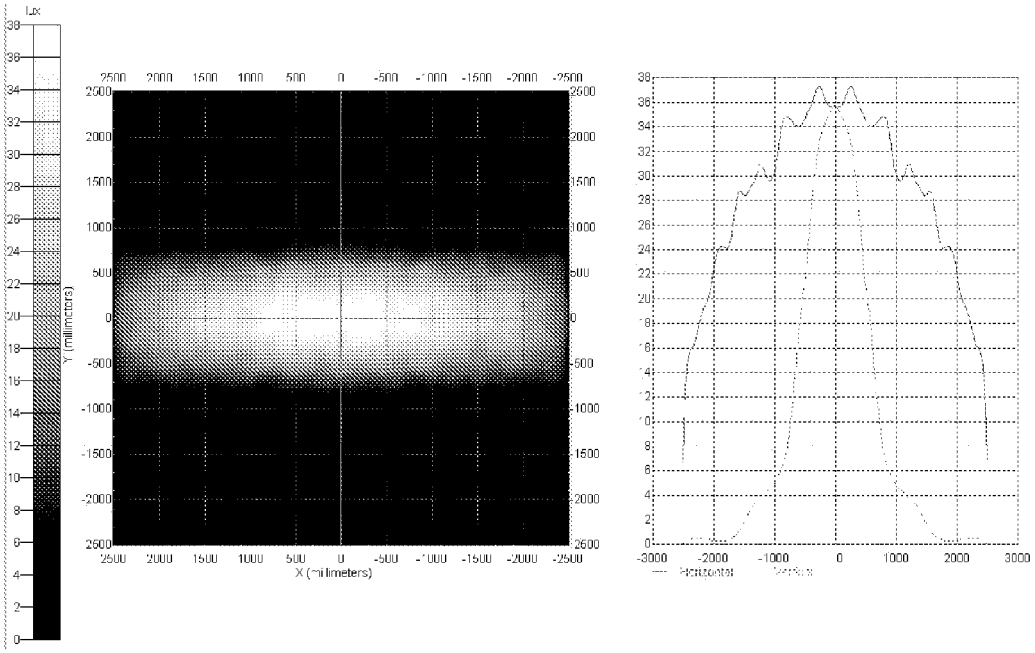
FIG. 18 is a schematic view showing an illumination experiment result of a second preferred embodiment of the present invention.

In the structural design of the optical refraction unit 1 of the second preferred embodiment as shown in FIG. 17, the LEDs 201 installed on the LED lamp strip emit light to the internal refractive surface 12, and its diffused light is divided into two paths to produce a refraction and a reflection. In other words, a first-time refraction occurs when the light at the middle is passed through the internal refractive surface 12, and a second-time refraction occurs when the light is passed through the external refractive surface 11, such that the lights of the LEDs 201 are distributed once again. A first-time reflection occurs at the reflective surface 14, when the lights are situated at the periphery or both lateral sides with a larger angle, and then a second-time refraction occurs when the light is passed through the external refractive surface 11, such that the angle of the light distribution at the edges is controlled within a range from 7 degrees to 40 degrees. In FIG. 18, with the aforementioned refraction and reflection, light spots projected on a plane become light spots with a strip-shape or an elliptical shape with a different aspect ratio, and such lamp shade can also achieve the effects of improving the illumination, enhancing the uniformity of the illumination, and saving power.

Figure 19:
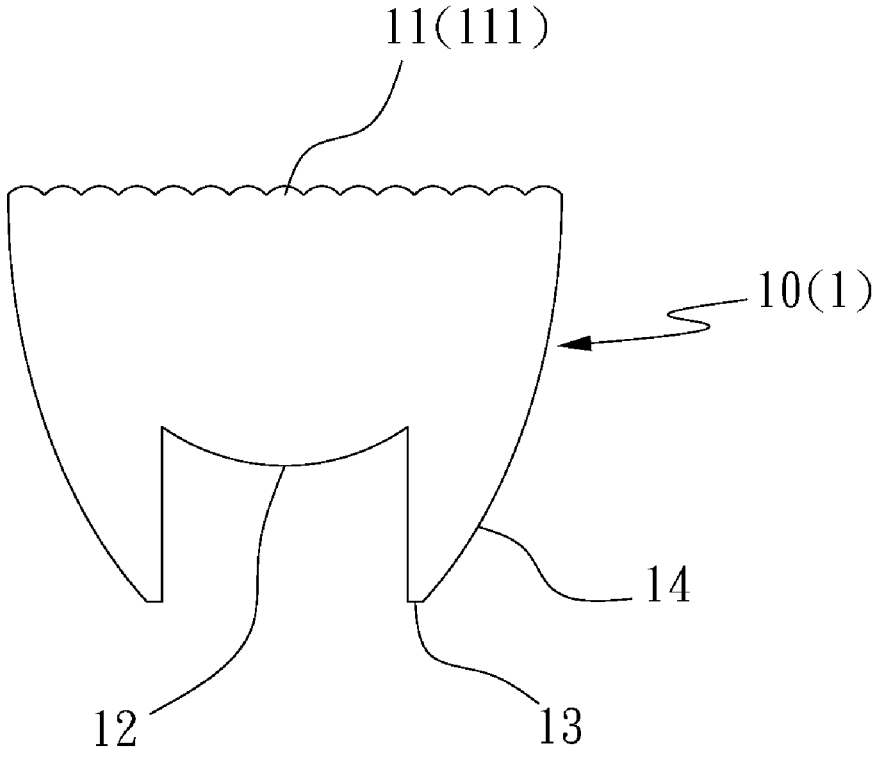
FIG. 19 is a schematic view showing a small curved surface of a second preferred embodiment of the present invention.

In FIG. 19, the present invention further provides a second referred embodiment to improve the aforementioned structural design of the optical refraction unit 1 and overcome the glare problem by adding a small curve 111 on the external refractive surface 11 of the optical refraction unit 1 protruded continuously along the curved surface. In order to apply the lamp shade to the lamps of various different shapes, the present invention further improves the aforementioned structural design of the optical refraction unit 1 by making the lamp shade 10 into a strip-shaped lamp shade, a fan-shaped lamp shade or a ring-shaped lamp shade. Similarly, the lamp shade includes two or more optical refraction units 1 in various different shapes as shown in FIGS. 7 to 14, and the details are the same as the previous embodiment, and thus will not be described here again.

In summation of the description above, the lamp shade of the present invention adopts a design with a special optical structure, such that a light passing through the lamp shade can be controlled and diffused uniformly within a specific range of angles to achieve the effects of improving the illumination, providing a uniform illumination, and saving energy. In addition, products of the invention can meet the market requirements, and the invention complies with patent application requirements, and thus is duly filed for patent application.

While the invention has been described by means of specific embodiments, numerous modifications and variations could be made thereto by those skilled in the art without departing from the scope and spirit of the invention set forth in the claims.

What is claimed is:

1. A variable shaped lamp shade of an LED lamp, and the lamp shade being made of a translucent material matched with a plurality of LED lamp strips and a plurality of lamp holders, and the lamp shade comprising:

a plurality of strip-shaped optical refraction units each having an external refractive surface, an internal refractive surface corresponding to the external refractive surface, and an assembling structure used for matching a respective lamp holder, wherein one of the external refractive surface and the internal refractive surface is formed on a curved surface without an inflection point, and the curved surface has one of a constant curvature and a gradually changing curvature, wherein the optical refraction units are radially and concentrically arranged to form a fan-shaped lamp shade.

2. The variable shaped lamp shade of an LED lamp as recited in claim 1, wherein the external refractive surface of the optical refraction unit is formed on a curved surface without an inflection point, and the curved surface has a constant or gradually changing curvature, and the internal refractive surface is a curved surface with one or more inflection points.

3. The variable shaped lamp shade of an LED lamp as recited in claim 2, wherein the external refractive surface has a curved surface continuously protruded along the profile of the curved surface.

4. The variable shaped lamp shade of an LED lamp as recited in claim 2, wherein the lamp shade is made of polycarbonate (PC).

5. The variable shaped lamp shade of an LED lamp as recited in claim 1, wherein the external refractive surface of the optical refraction unit is a non-curved surface, and the internal refractive surface of the optical refraction unit is a curved surface without an inflection point, and the curved surface has a constant or gradually changing curvature.

6. The variable shaped lamp shade of an LED lamp as recited in claim 5, further comprising two reflective surfaces formed on and coupled to lateral sides of the external refractive surface and the internal refractive surface respectively, and the reflective surfaces are outwardly convex curved surface.

7. The variable shaped lamp shade of an LED lamp as recited in claim 5, wherein the external refractive surface is a small curved surface continuously protruded along the profile of the non-curved surface.

8. The variable shaped lamp shade of an LED lamp as recited in claim 5, wherein the lamp shade is made of polycarbonate (PC).

* * * * *